US007915505B2

(12) United States Patent
Miniaev

(10) Patent No.: US 7,915,505 B2
(45) Date of Patent: Mar. 29, 2011

(54) MUSICAL INSTRUMENT

(75) Inventor: Viacheslav Miniaev, Overland Park, KS (US)

(73) Assignee: Eliton, LLC, Kansas City, MO (US)

( * ) Notice: Subject to any disclaimer, the term of this patent is extended or adjusted under 35 U.S.C. 154(b) by 222 days.

(21) Appl. No.: 12/123,305

(22) Filed: May 19, 2008

(65) Prior Publication Data

US 2009/0071318 A1 Mar. 19, 2009

Related U.S. Application Data

(60) Provisional application No. 61/052,219, filed on May 11, 2008, provisional application No. 60/938,676, filed on May 17, 2007.

(51) Int. Cl.
*G10D 3/00* (2006.01)
*G10D 3/02* (2006.01)

(52) U.S. Cl. ..... 84/291; 84/294; 84/743

(58) Field of Classification Search ..... 84/291, 84/731, 294, 743

See application file for complete search history.

(56) References Cited

U.S. PATENT DOCUMENTS

| | | | | |
|---|---|---|---|---|
| 1,699,384 | A * | 1/1929 | Welch | 84/274 |
| 3,595,981 | A * | 7/1971 | Hopping | 84/726 |
| 4,770,079 | A * | 9/1988 | Mastroianni | 84/291 |
| 6,255,565 | B1 * | 7/2001 | Tamura | 84/275 |
| 6,646,190 | B2 * | 11/2003 | Brown | 84/291 |
| 6,646,191 | B1 * | 11/2003 | Martin | 84/291 |
| 6,664,461 | B2 * | 12/2003 | Tamura | 84/743 |
| 7,514,614 | B2 * | 4/2009 | McGrew | 84/291 |
| 2007/0028752 | A1 * | 2/2007 | McGrew | 84/726 |

* cited by examiner

*Primary Examiner* — Jeffrey Donels

(74) *Attorney, Agent, or Firm* — Bryan P. Stanley; Kutak Rock LLP

(57) ABSTRACT

A musical instrument is provided. The instrument is light weight and portable. The instrument includes electrical pickup capabilities but also has the feel of an acoustic instrument. The instrument can be folded to an arrangement that is easy for transport. The folding instrument has maximum similarity to an acoustic cello, including the feel and size when unfolded. The instrument includes a floating soundboard to provide maximum acoustic feel. The instrument further includes an acoustic pickup.

18 Claims, 9 Drawing Sheets

MUSICAL INSTRUMENT

CROSS-REFERENCE TO RELATED APPLICATIONS

This application claims priority pursuant to 35 U.S.C. 119 (e) to U.S. Provisional Patent Application Ser. No. 60/938,676, filed May 17, 2007, and to U.S. Provisional Patent Application Ser. No. 61/052,219, filed May 11, 2008, the entire disclosures of which are incorporated herein by reference.

FIELD OF THE INVENTION

The present invention relates generally to a musical instrument, such as a cello. More specifically, the present invention is concerned with an electric instrument such as a cello that is portable, folding, lightweight and acoustically accurate.

BACKGROUND OF THE INVENTION

The violoncello, usually abbreviated as a cello, dates back to 1660 and is a member of the violin family. It is a four string instrument that produces a deep, rich, and vibrant sound. The cello reaches a pitch between the viola and the double bass. The cello has evolved throughout the years and the first cellos were larger than today's cellos. The cello size was standardized in the mid-1700's to the size and shape and string number that it has today.

A conventional cello usually consists of a body; four strings; a neck, pegbox and scroll; a tailpiece and endpin; a bridge and f-holes. A bow is then pulled across the strings to make the sound. The main frame of the cello is typically made from wood, although some modern cellos are constructed from carbon fiber or laminate. The cello body has a wide top bout, narrow middle formed by two c-bouts, a wide bottom bout, with the bridge and sound holes just below the middle. The top and back of a cello are traditionally hand-carved but can be machine-produced.

Above the main body is the carved neck of the instrument which leads to a pegbox and scroll. The neck, pegbox, and scroll are normally carved out of a single piece of wood, such as, for example, maple. Attached to the neck and extending over the body of the instrument is the fingerboard. The nut is a raised piece of wood, where the fingerboard meets the pegbox, and on which the four strings rest with corresponding tuning pegs housed in the pegbox. The pegs are used to tune the cello by either tightening or loosening the string. The scroll is simply a decorative part of a traditional cello.

At the lower part of the cello is the tailpiece and the endpin. The tailpiece attaches the strings to the lower end of the cello and can have fine tuners as well. The endpin supports the cello in playing position. The tailpiece is traditionally made of ebony or other hard wood but can also be made of plastic or steel. The endpin can be retractable and adjustable to the individual player and is usually made of wood, metal, or another suitable material.

The bridge elevates the strings above the cello and transfers the vibrations to the top of the instrument to the soundpost located inside the instrument. Located on either side of the bridge are the f-holes which allow air to move in and out of the instrument to produce sound. Finally, a bow is pulled across the strings to vibrate the strings and emit sound from the cello.

The basic make and shape of the cello has not changed for hundreds of years. As musicians have become more mobile and transportation has changed from train to airplane travel, so has the desire to have a cello that is easily transported. A traditional cello is easily damaged when traveling. Being tossed around can damage the instrument on the outside but more importantly can effect the integrity and sound of the instrument. Additionally, a traditional cello is large and difficult to transport on an airplane. As security on airplanes has heightened, airlines will not allow instruments to be carried onto an airplane unless a separate ticket is purchased for the instrument if it will not fit in the overhead compartment. This means that the cello in its case has to be checked with other baggage, which opens up the possibility for damage. Portable cellos have appeared in the market, but such instruments are still relatively heavy and large. Also, due to the design and materials used to make portable cellos, such instruments do not sound and, more importantly, feel like a traditional cello. Therefore, it would be beneficial to provide a cello that is lightweight and portable and that maintains the feel of a traditional acoustic cello. Further, since travel has become such a large part of a performing musicians' life it would be beneficial to provide a cello that travels easier and that also can be used to practice without disturbing others because it is like a quiet cello.

With the introduction of the electromagnetic pickup and piezoelectric pickups electric instruments emerged, including the electric cello. The problem with these types of cellos is that the feel and the sound do not imitate an acoustic cello. Therefore, it would be beneficial to provide an electric cello that has the feel of a traditional acoustic cello.

SUMMARY OF THE INVENTION

A principal object of the present invention is to provide a musical instrument that is light weight and portable. Another object of the invention is to provide an electric instrument that has the feel of an acoustic instrument. Another object of the invention is to provide a folding musical instrument, such as, for example a cello. Another object of the invention is to provide a folding cello that is small in size when folded and is lightweight. Another object of the invention is to provide a folding cello having a maximum similarity to an acoustic cello, including the feel and size (unfolded). Yet another object of the invention is to provide a folding cello that allows for electronic amplification of sounds through a pickup, such as, for example an electromagnetic or piezoelectric pickup.

The objects of the instant invention are accomplished through the use of a folding instrument, such as a cello, that is dimensionally accurate when unfolded including a suspended soundboard to provide the feel of an acoustic cello, pickup acoustic headphones that allow the player to control and manipulate the sounds of the folding cello as an acoustic cello, and pickups to amplify the sound, such as, for example electromagnetic or piezoelectric pickups.

The instant invention solves two serious issues for traveling cellists: transportation and size. A standard acoustic cello does not fit into an overhead compartment of an airplane and thus if the musician wishes to keep the instrument in maximum safety, a separate ticket for the cello is needed. On the other hand, the musician may submit the cello into luggage but that adds risk to possible damage through the commute. Due to the folded cello's dimensions, the musician can now easily store the instrument in the overhead compartment. Furthermore, the cello's design provides for maximum protection due to the sturdiness of the materials used and the simplicity of the layout design. If the instrument is dropped, minimal damage occurs while the instrument is folded. In comparison to other instruments on the market, the folding cello provides a lighter, smaller, less bulky instrument with the benefits of maximum acoustic feel.

It will be appreciated that although the instant invention is shown and described to mimic a cello the folding instrument with advanced acoustic potential may be applied to other stringed instruments, such as, for example, double-bass, viola, violin, and the like. It will also be appreciated that the soundboard may be applied to accommodate sound production on a variety of other instruments, such as, for example, guitars, mandolins, lutes, banjos, and the like.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of the invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

A preferred embodiment of the invention, illustrative of the best mode in which the applicant has contemplated applying the principles, is set forth in the following description and is shown in the drawings and is particularly and distinctly pointed out and set forth in the appended claims.

DETAILED DESCRIPTION OF A PREFERRED EMBODIMENT

As required, a detailed embodiment of the present inventions is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
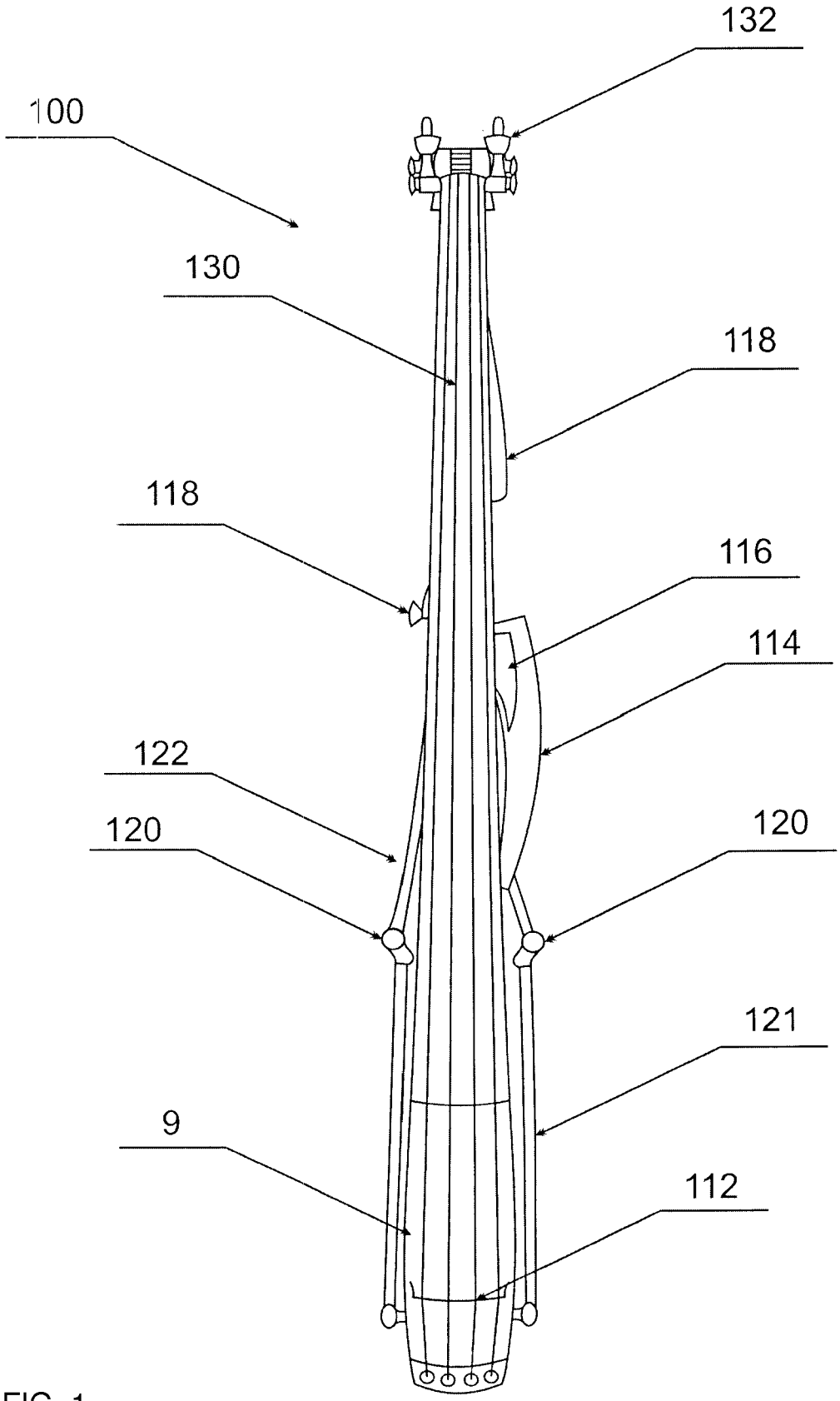
FIG. 1 is a front view of a cello of an embodiment of the instant invention in a folded/collapsed arrangement.
Figure 2:
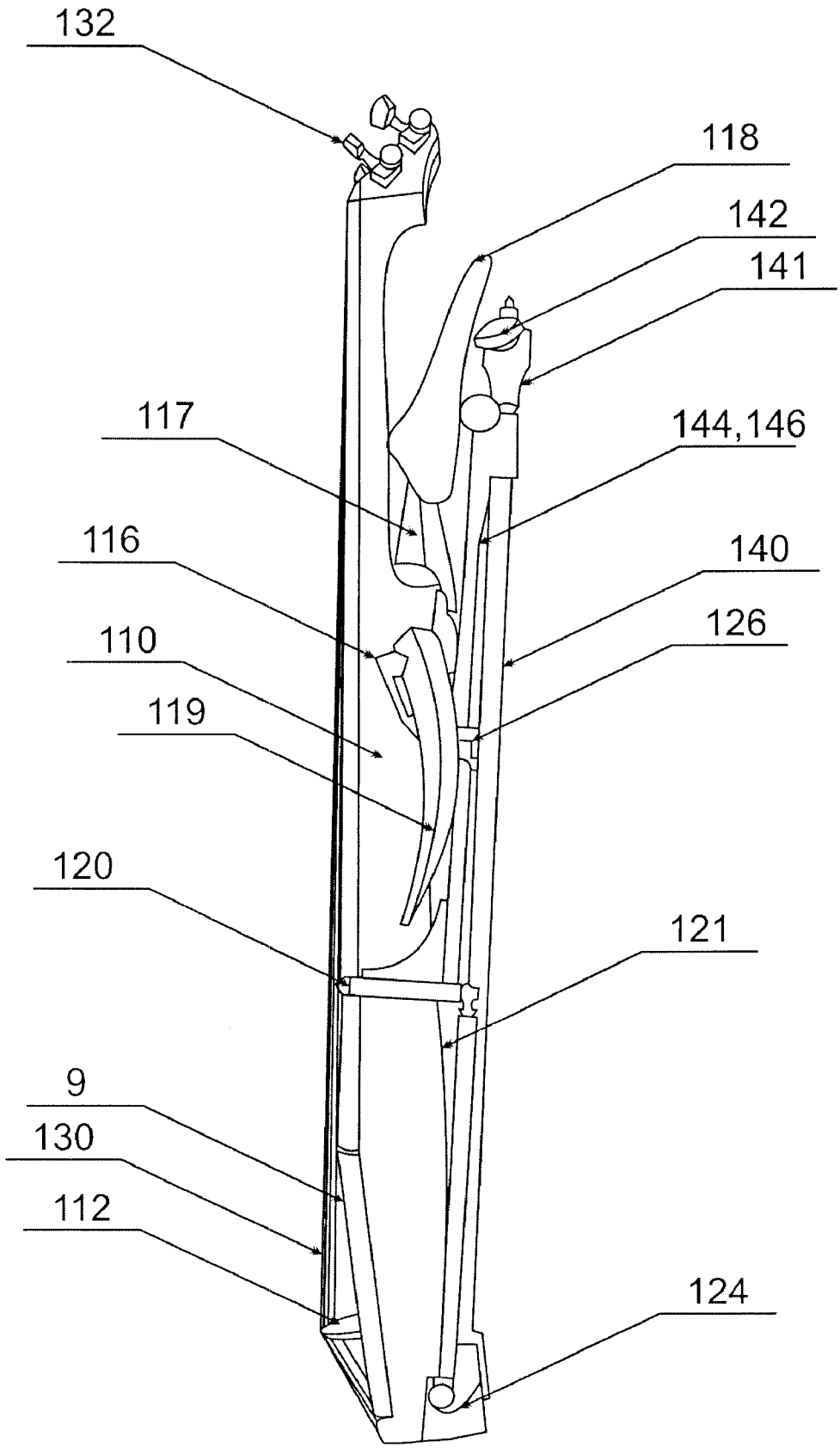
FIG. 2 is a side view of the cello of FIG. 1 in the folded/collapsed arrangement.
Figure 3:
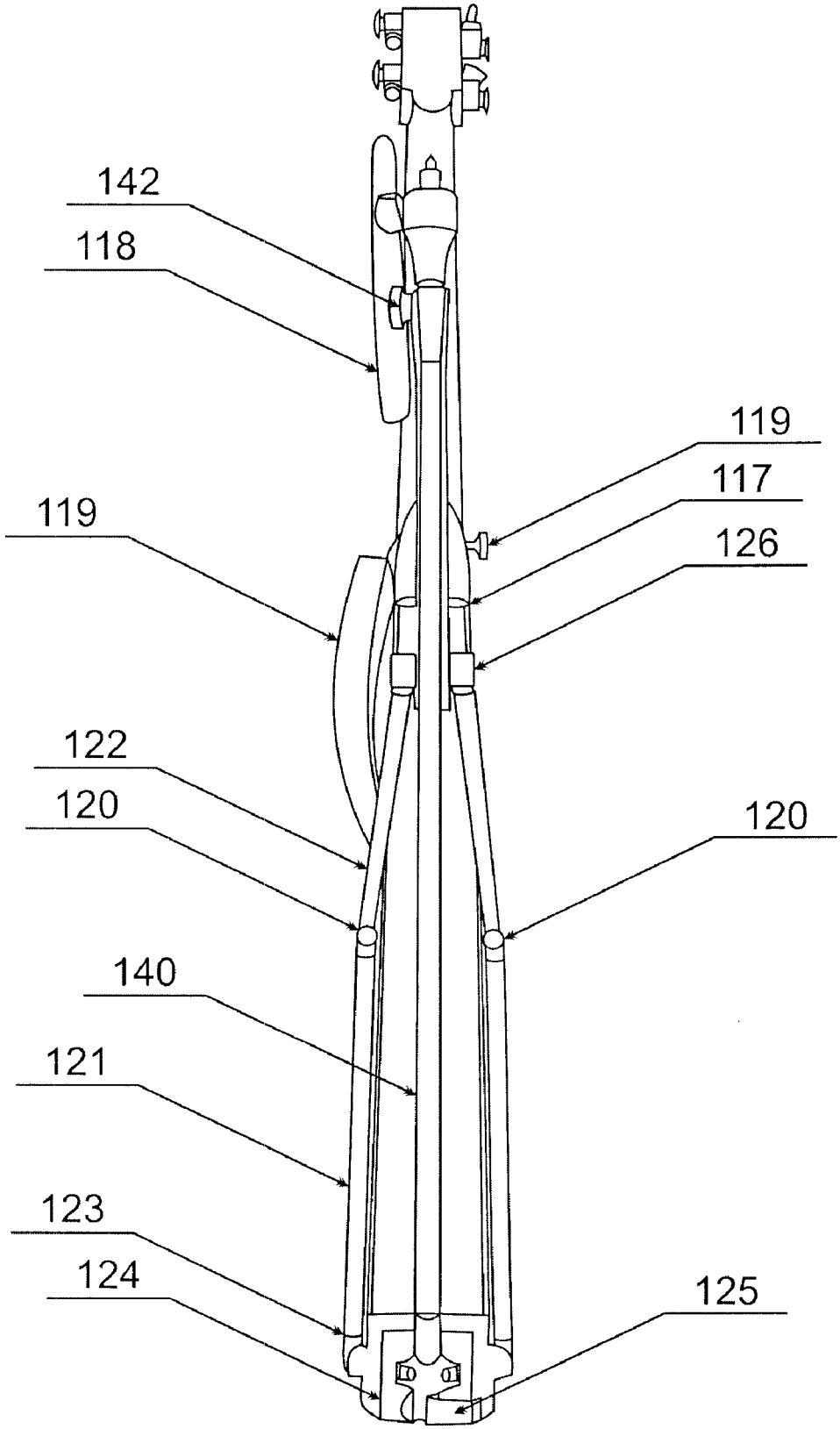
FIG. 3 is a rear view of the cello of FIG. 1 in the folded/collapsed arrangement.
Figure 4:
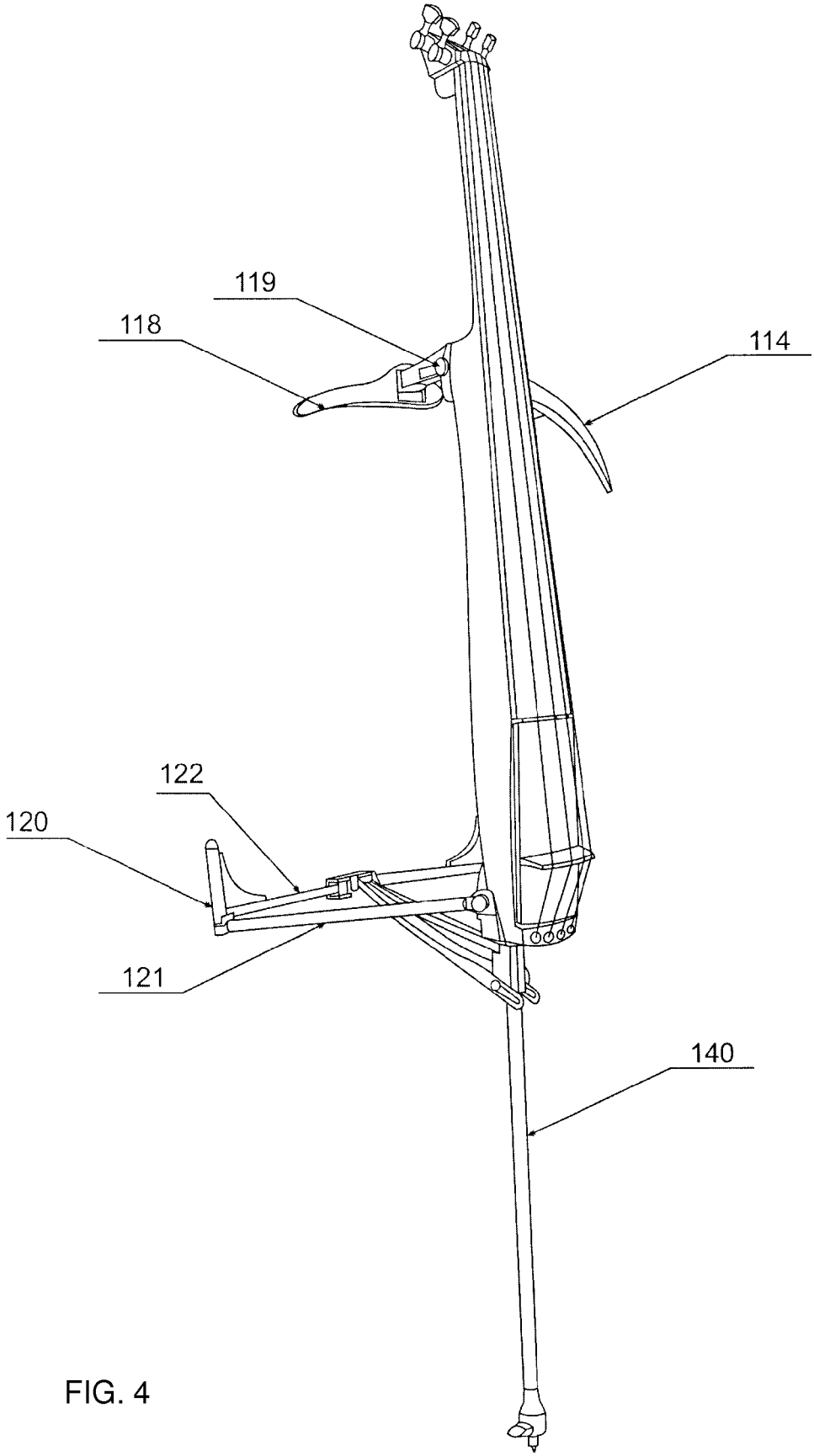
FIG. 4 is a front view of the cello of FIG. 1 in an unfolded/expanded arrangement.
Figure 5:
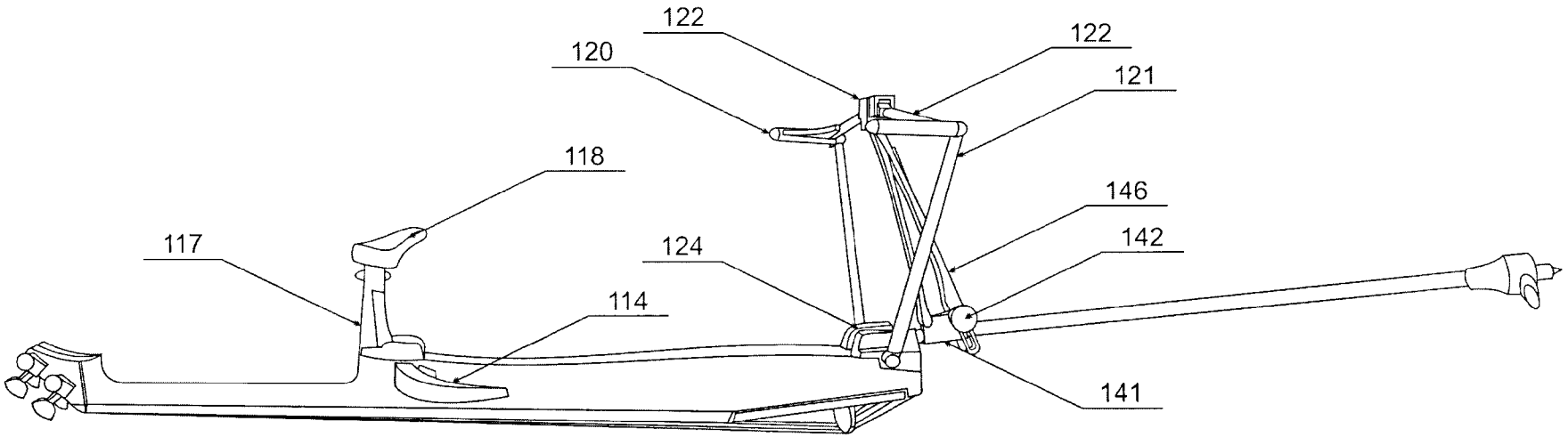
FIG. 5 is a side view of the cello of FIG. 1 in an unfolded/expanded arrangement in which the leg support is shown in a partially lowered position.
Figure 6:
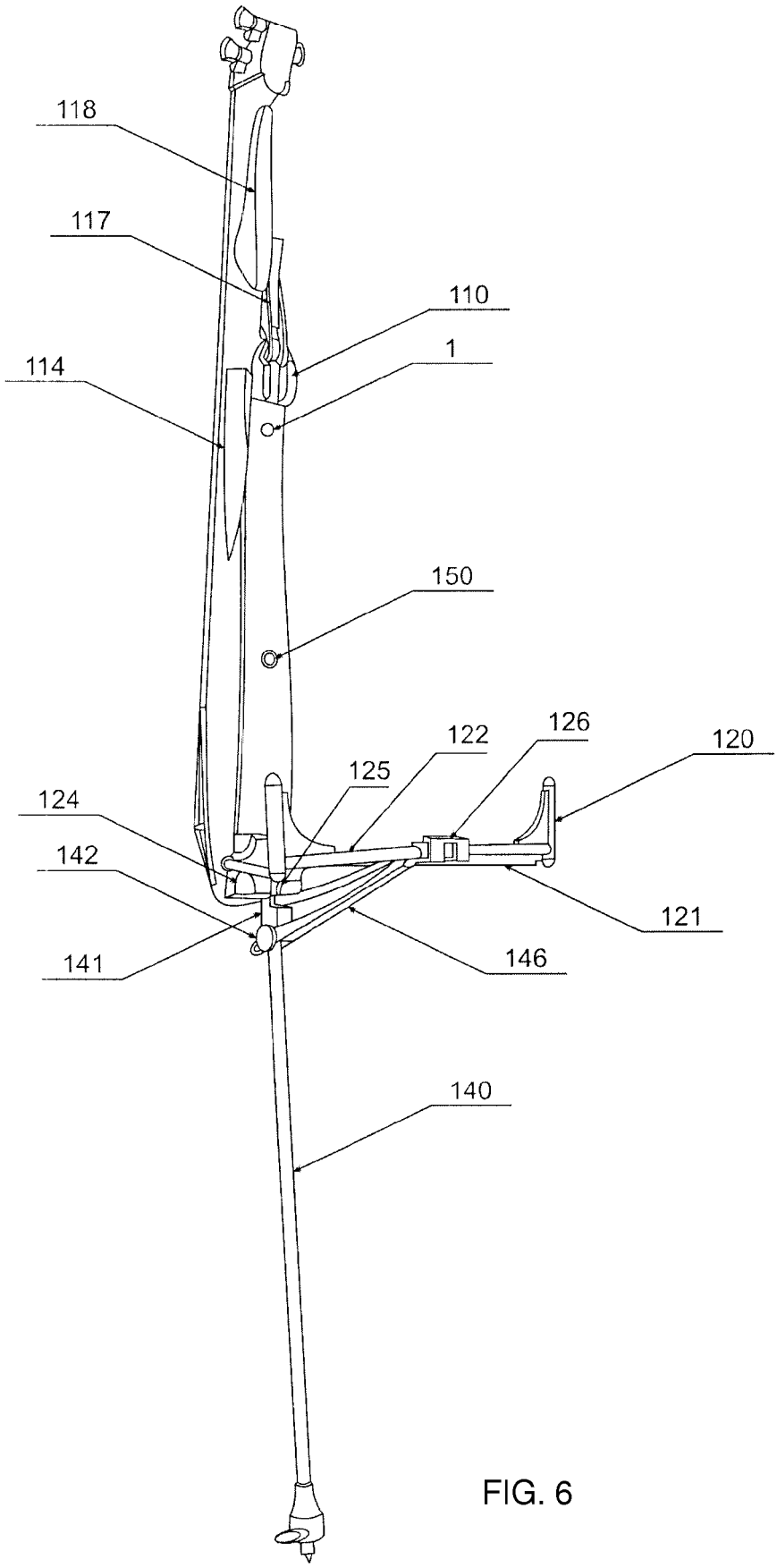
FIG. 6 is a rear view of the cello of FIG. 1 in an unfolded/expanded arrangement in which the leg support is shown in a partially lowered position.

Referring to FIGS. 1-3 a folding cello of a first embodiment of the instant invention is shown in a fully folded arrangement. Referring to FIGS. 4-6, the cello of FIGS. 1-3 is shown in an unfolded arrangement.

In the embodiment shown in FIGS. 1-6, folding cello 100 generally includes a body (110) and a base. Body 110 of folding cello 100 generally includes a neck, a fingerboard, bridge 112, a nut, soundboard 9, at least one set of tuning pegs (132), four strings (130), chest-support 118 and upper bout support 114. The body (110) is generally assembled and constructed similar to the body of a prior art cello with a primary difference being that the bridge stands on a suspended soundboard (9) rather than on a solid body as is common for a cello as well as other stringed instruments. The body of the cello of the invention may be constructed from various woods, metals, plastics, laminates, Plexiglas materials, carbon-fiber materials, or other appropriate materials as any typical acoustic or electric cello is made from that is now known or hereinafter discovered. In the embodiment shown in FIGS. 1-6, the body of the cello of the invention is generally hollow. In an alternative embodiment (not shown), the hollow body includes a space to accommodate a portion of a center section of the base when folded up.

In the embodiment of cello 100 shown in FIGS. 1-6, chest support 118 and upper bout support 114 fold against body 110 to make cello 100 more compact. In one alternative embodiment the chest support and the upper bout support are removably attached to the body of the cello via slots on the back and/or side(s) of the body that correspond with tabs on the end of the chest support and upper bout support. The tabs are placed in the slots to connect the chest support and upper bout support to the folding cello.

In the embodiment of chest support 118 and upper bout support 114 shown in FIGS. 1-6, both chest support 118 and upper bout support 114 are rotatably attached to cello body 110. Chest support 118 is mounted to body 110 of the cello 100 by a rotating bracket 117 and is locked into the unfolded position by thumbwheel 119 that presses a set screw of the thumbwheel in engagement with bracket 117 when the chest support is unfolded. Bracket 117 is generally L-shaped with the shorter leg of the bracket extending into cello body 110. Bracket 117 is rotated from a position in which the longer leg of bracket 117 is either perpendicular to body 110 (as is shown in FIG. 5) or parallel to body 110 (as is shown in FIG. 2). When the long leg is rotated to be perpendicular, the short leg will lie flat against a support member located within cello body 110, so that bracket 117 cannot be over rotated.

When the long leg is rotated perpendicular to cello body 110, thumbwheel 119 which is mounted to the support framework of rotating bracket 117 is used to extend the set screw portion of the thumbwheel through a predrilled hole in the long leg of bracket 117 to lock the bracket in the perpendicular position. FIG. 2 is a detail view of the chest support with the rotating bracket in the unfolded position and the chest support folded parallel to the base portion of the chest support, which base portion of the chest support connects the chest support portion to the rotating bracket. Chest support 118 is pivotally connected to the upper end of the long leg of bracket 117 so that chest support 118 can be pivoted from a position generally parallel to the long leg (as shown in FIGS. 1-3) for storage, to a position generally perpendicular to the long leg (as shown in FIGS. 4-6) for use when playing. This allows chest support 118 to be folded completely out of the way of center section 140 when it is folded upward. In addition, the long leg of bracket 117 and the support framework of bracket 117 include a groove that is generally parallel to cello body 110 so that center section 140 can be folded generally flat against cello body 110 within the groove.

Upper bout support 114 rotates about a pin that is connected to body 110 of cello 100. As upper bout support 114 is rotated outward spring-loaded hinge 116, positioned between upper bout support 114 and body 110 of the cello unfolds to hold upper bout support 114 in a locked, unfolded position. Hinge 116 includes a plate member that has one edge generally shaped to conform to the curved shape of bout support 114, to provide a tight fit when fully unfolded. When in the folded position, the flat face of the plate member lies flat against the side of body 110 of the cello. When unfolded, the flat face is generally perpendicular to body 110, locking upper bout support 114 in the unfolded arrangement. To fold, the musician folds hinge 116 down and rotates upper bout support 114 toward body 110 so that the face of the plate member is flat against body 110.

The base of the folding cello generally includes: center section 140 including an endpin, folding mechanism 124 connecting center section 140 of the base to the lower portion of body 110 of cello 100; and a pair of leg supports 120. The base may be constructed from metals, woods, plastics, laminates, Plexiglas materials, carbon-fiber materials or other appropriate materials now known or hereinafter discovered. The center section (140) is attached at one end to folding mechanism 124, which connects the base to body 110 of the cello and allows for the folding movement of the base. Center section 140 is further connected to the pair of leg supports 120. The leg supports (120) are adjustable via sliding block mechanism 141 that moves up and down center section 140 and clamps in place using thumb wheel 142 to frictionally engage a set screw against center section 140 for customization of the position of leg supports 120 of folding cello 100 by the musician. The endpin is coupled to the opposite end of center section 140 from folding mechanism 124. The endpin is telescopically adjustable for customization of the height of the folding cello by the musician. The endpin is typically retracted when cello 100 is in a folded arrangement and may be extended to a desired length by a musician and then locked into place via a set screw and thumb wheel.

Cello 100 is shown in a folded arrangement in FIGS. 1-3. As is shown in FIGS. 1-3, leg supports 120 and the associated framework for leg supports 120, as well as center section 140 fold around body 110 of cello 100. This construction provides added protection against damage to body 110 because the base shields body 110 of cello 100 from impacts and other possible causes of damage when folded up for traveling.

In operation folding cello 100 is unfolded by rotating center section 140 of the base via folding mechanism 124 until center section 140 is extending downward generally in the same plane as body 110 as is shown in FIGS. 4-6. Center Section 140 is rotatably mounted at one end to folding mechanism 124 within a groove that runs parallel to body 110 of cello 100. Center section 140 is mounted within the groove via a pin connection at the center of the groove. The pin allows center section 140 to be rotated or folded up such that center section is flat against the back of cello body 110 as shown in FIGS. 1-3, and allows center section 140 to be folded down in the arrangement shown in FIGS. 4-6. As center section 140 is rotated downward, center section 140 pushes against the top surface of spring-loaded slide mechanism 125. The top surface of slide 125 slopes downward toward the groove such that the downward force of center section 140 pushing on the sloping surface creates an outward force on slide 125. This causes slide 125 to be pushed outward from its position that at least partially covers the bottom of the groove in folding mechanism 124. When center section 140 is fully rotated downward, such that center section 140 is fully maintained within the groove, the spring of spring-loaded slide 125 will urge slide 125 back into position covering the groove and thus locking center section 140 into the unfolded arrangement. To unfold center section 140, the musician pushes slide 125 outward to uncover the groove and center section 140 and then rotates center section 140 upward out of the groove and past slide 125 while holding the slide. Once center section 140 has passed slide 125, slide 125 can be released. It will be appreciated that other mechanisms may be used to attach the base to the body and allow for the rotation of the base out and away from the body. In one alternative embodiment, the base is locked and secured into the unfolded position using a block of wood or other suitable material as a securing mechanism to prevent the base from refolding, slipping or moving while the cello is being played.

As center section 140 is rotated downward from its folded position, legs supports 120 are also rotated outward away from cello body 110. Leg supports 120 are each pivotally (connection 123) connected to cello body 110 at each side of folding mechanism 124 via linkage arm 121. Each leg support is also connected to center section 140 via linkage arm 122 that pivotally connects to collapsing mechanism 126. Collapsing mechanism is pivotally connected to linkage arms 144 and 146, which are pivotally connected to sliding block 141. The height of and spacing between leg supports 121 can be adjusted using sliding block 141 either by sliding upward or downward along center section 140. Sliding block 141 is locked into position using thumb wheel 142 to clamp block 141 to center section 140. Thumb wheel 142 also clamps the end of linkage arm 146 to block 141. Linkage arm 145 includes a groove in which the set screw of thumbwheel slides and that allows the length of linkage arm 145 to be adjusted as block 141 slides up and down the center section 140. To fold center section 140, sliding block 141 is slid downward along center section 140 to generally straighten linkage arms 121, 122, 144 and 146 such that they are all generally parallel to center section 140. As linkage arms 144 and 146 are straightened, linkage arm 144 folds flat against center section 140 and linkage arm 146 folds flat against linkage arm 144. collapsing mechanism 126 includes a notched portion that allows collapsing mechanism 126 to lie generally flat over center section 140.

When center section 140 is folded, the endpin is left in a retracted position to make cello 100 more compact. When center section is unfolded, the endpin can be telescopically extended to adjust the height of cello 100 to the musician. The endpin is held in position by a thumbwheel that clamps and/or releases the endpin.

In one embodiment of the instant invention, folding cello 100 is designed to correspond to a full size (4/4) acoustic cello when unfolded. Similarities between a standard acoustic cello and folding cello 100 include, but are not limited to, the following: the distance of a vibrating string from the nut to bridge 112 of the instrument; the dimensions of the neck; the dimensions of the fingerboard; the angle and the angular adjustment of the instrument; the position of chest support 118; and the location and configuration of upper bout support 114. These similarities create the feel of an acoustic cello when held and played by a musician.

In the preferred embodiment of cello 100, bridge 112 of cello 100 stands on soundboard 9 that is suspended using springs or other suitable components/connectors (such as rubber, sponge, etc.) to allow soundboard 9 to vibrate independent of cello body 110. This differs from electric stringed instruments in which the bridge stands on a solid body of the instrument. The addition of the suspended soundboard of the instant invention gives the musician the feeling of an acoustic instrument. Further, sound manipulation and control equals that of an acoustic cello. Touch and feel are important to a musician and one problem with previous types of portable cellos, including electric cellos, is that they do not feel like an acoustic cello. As musicians have become more mobile it is important for them to be able to practice and not lose the muscle memory and other important aspects of playing an instrument. Therefore, it is important to have an instrument that feels like the instrument the musician is used to playing. As a musician progresses in skills this becomes even more important. Suspended soundboard 9 of the instant invention allows for folding cello 100 to feel like an acoustic cello. In one preferred embodiment a carrying case, either of a soft or hard construction, is provided to fit the folding cello and a bow.

Due to the suspended soundboard's ability to deliver precise sound manipulation the instrument requires a similarly precise pickup. Two types of pickups commonly used are the electromagnetic pickup and the piezoelectric pickup, although it will be appreciated that other types of pickups may be used without departing from the spirit and scope of the instant invention. A problem with electromagnetic and piezoelectric type pickups is that such pickups convert acoustic vibrations into electric signals, significantly reducing the sound quality. In several embodiments of the instant invention, an acoustic pickup is attached to the body of the folding cello. The acoustic pickup is coupled to the underside of the soundboard with a tubing material attached to the acoustic pickup that stretches from the acoustic pickup toward the upper portion of the body. In one embodiment, the acoustic pickup comprises a stethoscope end (or other apparatus manufactured in a manner and to provide sound detection similar that of a stethoscope) coupled to the underside of the soundboard. In one embodiment, the tubing material includes an end that is located in or otherwise attached to the body of the cello such that the musician can attach a set of headphones or other similar devices to the end of the tubing material. The tubing material delivers acoustic vibrations directly to the musician's ears without losing quality or having electrical interference. The quality of the sound is better than traditional pickups because the vibrations are carried directly to the musician rather than being converted to electric signals.

Figure 7:
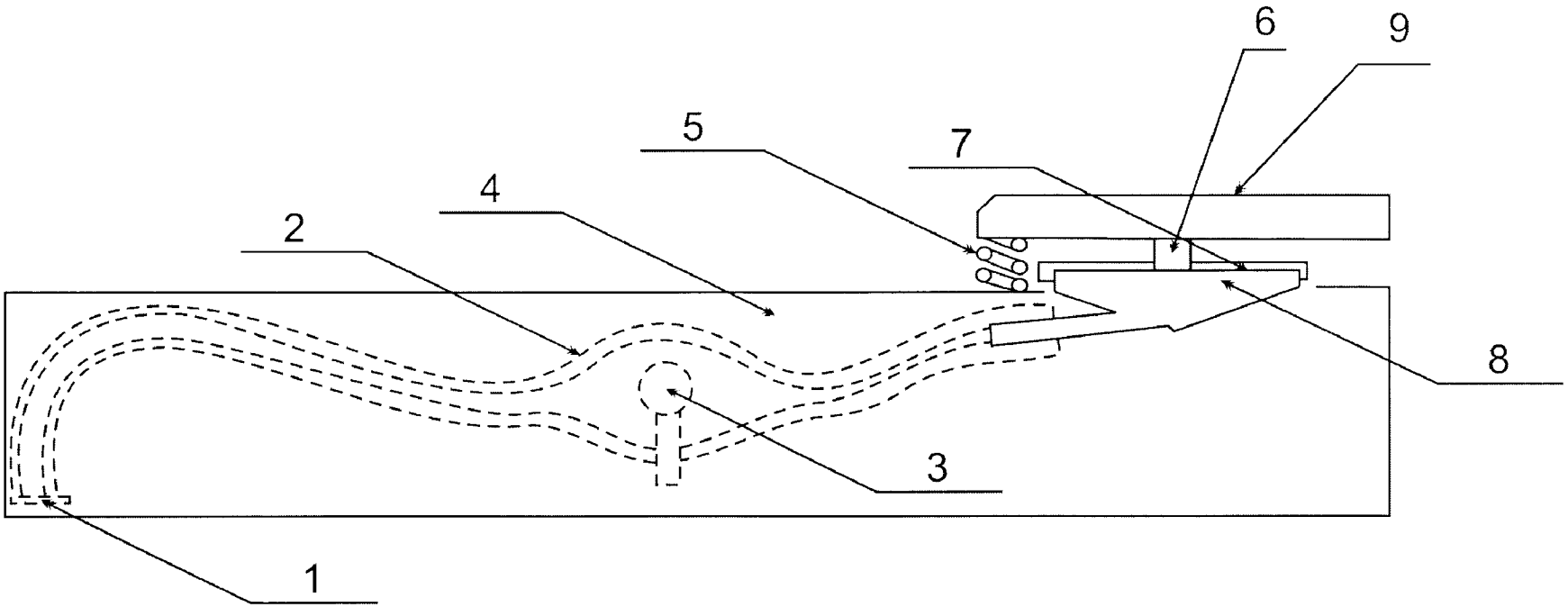
FIG. 7 is a partial cross sectional view of an embodiment of an acoustic pickup within a cello of the instant invention.

Referring to FIG. 7, an acoustic pickup of one embodiment of the invention is shown. Although, the acoustic pickup of FIG. 7 is shown in connection with a soundboard (9) that is not flush (as opposed to the soundboard of the embodiment shown in FIGS. 1-6), it will be appreciated that the acoustic pickup shown in FIG. 7 could be used with such a flush arrangement. Furthermore, the acoustic pickup may be used with either floating or non-floating soundboard arrangements. The acoustic pickup generally includes, but is not limited to, the following features: (1) an airtight connection or coupler to headphones; (2) the tubing material that is flexible in nature (i.e. tubing of a stethoscope); (3) a microphone inside an airtight space within the tubing material; (4) a hollow area within the body of the cello; (5) the spring of the soundboard; (6) a solid material connector that provides a physical link from the soundboard to a diaphragm of a stethoscope; (7) the stethoscope diaphragm; (8) a stethoscope end piece/head; and (9) the soundboard.

The acoustic pickup utilizes the same concept as used by a medical stethoscope (which includes the stethoscope diaphragm within the stethoscope end piece) to capture and deliver the vibrations to the user's ears. In one embodiment, a set of acoustic headphones delivers the vibrations from the stethoscope of the acoustic pickup to the musician. The acoustic headphone set may be made using two identical stethoscope end/ear pieces serving as the right and left headphone. A headphone tubing is attached to the acoustic headphone set that is attachable to the tubing material of the acoustic pickup. In another embodiment, the acoustic headphone set may be a standard stethoscope headset without the stethoscope end/ear piece attached and using an alternative ear piece such as an ear-muff style ear piece. It will be appreciated that the headphone set of the instant invention may be constructed in various different ways using known materials that allow for the carrying of vibrations from the soundboard to the musician. The acoustic headphones provide an accurate transmission of the natural vibrations of the folding cello that the acoustic pickup captures. The acoustic headphones are removably attached by attaching the tubing to or removing the tubing from a connector/coupling. Microphone 3 shown in FIG. 7 inserted into tubing 2 allows for additional amplification of the sound. It will be appreciated that the acoustic pickup described herein may be utilized without the inclusion of microphone 3. Furthermore, it will be appreciated that alternative arrangements (such as described herein below) for microphone 3 (or other electric pickups) may be utilized in which the pickup/microphone is not located within tubing 2.

Referring to FIG. 7, solid material connector 6 is shown linking soundboard 9 to stethoscope membrane 7. The solid material connector transfers the vibrations of the soundboard to the stethoscope membrane which in turn transfers the vibrations through the tubing material to the headphones. The solid material connector of one embodiment is made of a generally soft material, such as, for example, cork or rubber. In another embodiment, the solid material connector is made from a hard material, such as, for example, wood. The softer the material that is used to make the solid material connector the softer the sound. The harder the material used the stronger and drier the sound. Additionally, the size of the solid material connector changes the sound that is produced. It will be appreciated that the specific type of material and size of material used for the solid material connector to provide the desired sound and feel for any given instrument of the instant invention will be readily apparent to a person of ordinary skill in the art.

Figure 8:
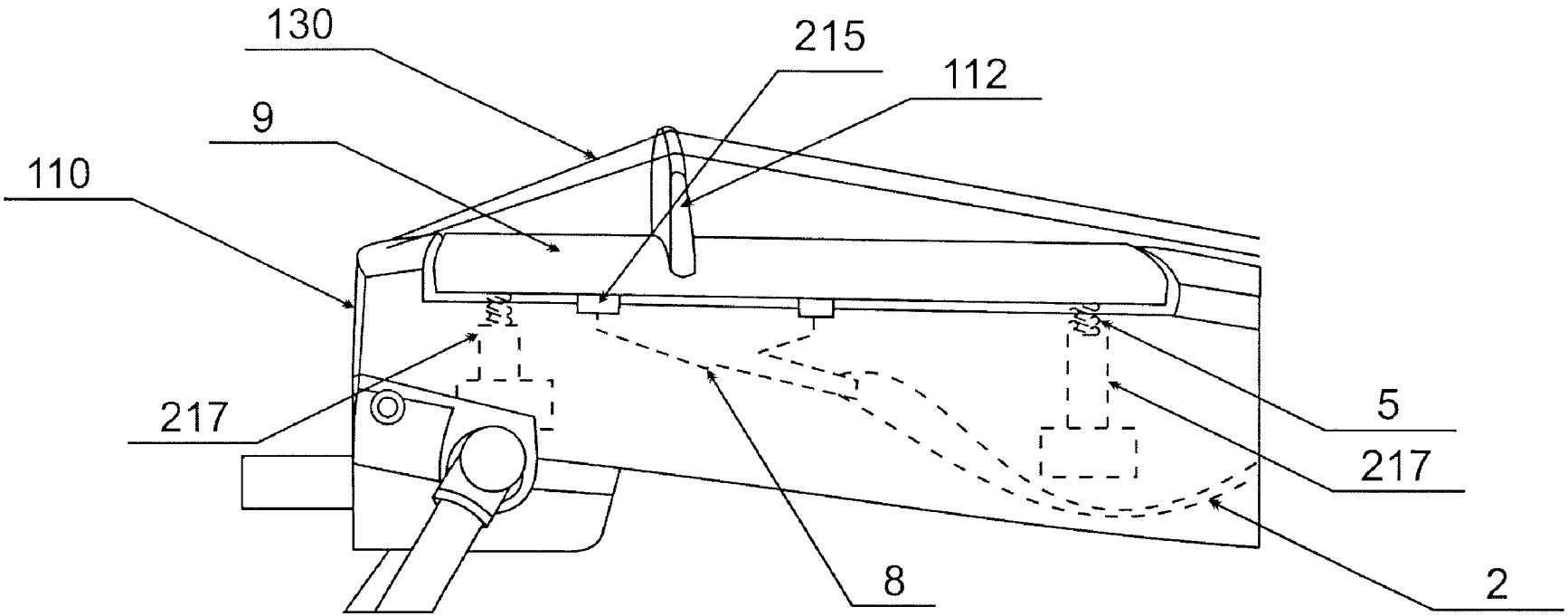
FIG. 8 is a partial cross sectional view of another embodiment of an acoustic pickup shown within the cello of FIG. 1.

Referring to FIG. 8, another embodiment of the acoustic pickup of the instant invention is shown and described. The acoustic pickup is shown in connection with a flush-mounted sound board (9), such as the flush-mounted arrangement shown in FIGS. 1-6. Nevertheless, it will be a appreciated that the acoustic pickup shown in FIG. 8 may be utilized in connection with any soundboard arrangement, including flush-mount or non-flush mount, as well as non-floating or floating soundboard arrangements.

In the embodiment shown in FIG. 8, soundboard 9 is suspended flush to the surface of cello body 110 via springs 5 that connect soundboard 9 to support posts 217. Support posts 217 are attached within the hollow portion of body 110 so as to allow soundboard 9 to be mounted flush to body 110 (as opposed to protruding outward from body 110 in the manner shown in FIG. 7). In a preferred embodiment, soundboard 9 is connected to posts 217 via four springs, one spring located near each corner of soundboard 9. Nevertheless, it will be appreciated that the number and position of springs connecting soundboard 9 to body 110 can be adjusted depending upon the instrument design and performance requirements without departing from the spirit and scope of the instant invention.

In the embodiment of the acoustic pickup shown in FIG. 8, the acoustic pickup is head 8 of a stethoscope; however, the acoustic membrane has been removed leaving only the open chamber of the stethoscope head. The outer-rim of head 8 is attached to foam ring 215 via glue or another suitable tacky substance (in the depicted embodiment, the foam itself is tacky in nature or includes the tacky substance). Foam ring 215 is then attached directly to the rear side of soundboard 9.

This provides a direct connection between the rear of the soundboard and the interior of the chamber of head 8 (i.e. the open part of the ring leaves the surface of the soundboard exposed to the interior of the chamber of the stethoscope pickup head). The tacky foam provides a hermetic (airtight) seal between the stethoscope head and the soundboard. Head 8 of the stethoscope is connected to coupler 1 via rubber tubing 2. In the embodiment shown in FIG. 8 a notch is cut in one of supports 217 to allow tubing to pass through toward the top of cello body 110. Coupler 1 is attached to the back of cello body 110 (see FIG. 6) to allow a musician to plug headphones into coupler 1 without the need to remove the back cover/surface of cello body 110.

Figure 9:
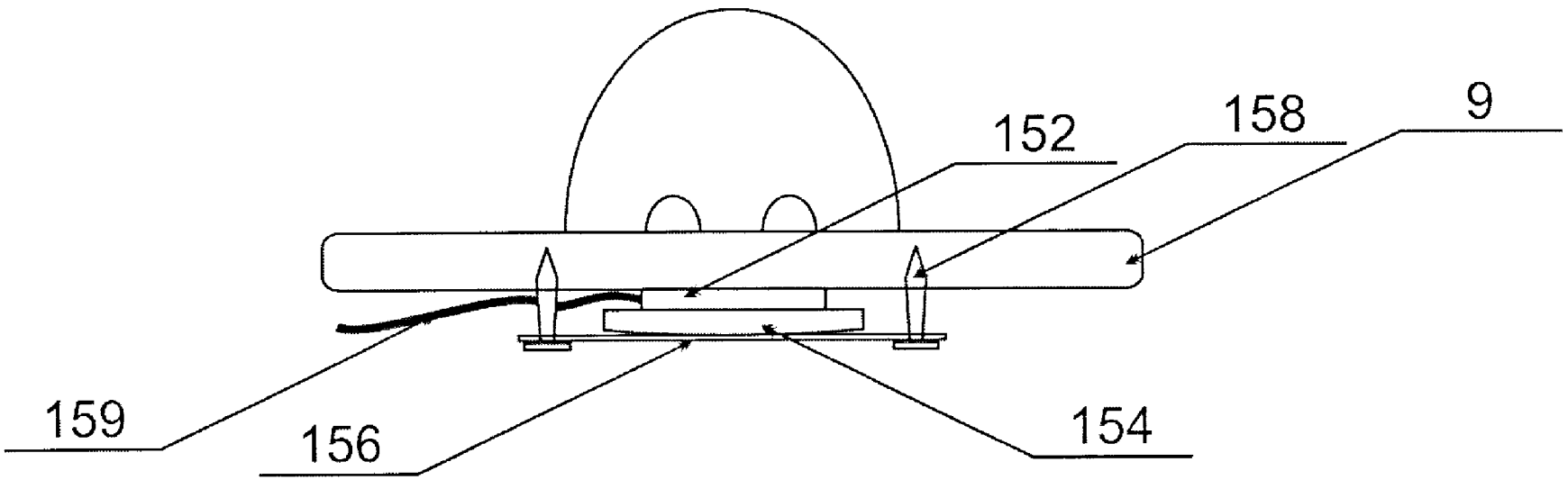
FIG. 9 is a partial cross sectional view of a piezoelectric pickup and soundboard of the instant invention.

The acoustic pickup does not limit the musician from using a traditional electronic pickup for sound amplification. In one embodiment shown in FIG. 9 a piezoelectric pickup is attached to soundboard 9 of the folding cello of the instant invention. Referring to FIG. 9 a detail view of piezoelectric pickup 152 connected to soundboard 9 is described. In the embodiment shown, piezoelectric pickup 152 is attached directly to the rear surface of soundboard 9 by glue or some other suitable means. The pickup is attached by sandwiching piezoelectric pickup 152 between soundboard 9 and plate/cover member 156. In one embodiment plate/cover member 156 is made of plastic, nevertheless it will be appreciated that other materials may be utilized without departing from the spirit and scope of the instant invention. A piece of foam (154) is positioned between plate 156 and piezoelectric pickup 152 to reduce vibration/noise between the piezoelectric pickup and the plate (i.e. to isolate pickup 152 so that it only picks up vibrations from soundboard 9 to which it is directly in contact). Screws 158 extend through plate 156 and into soundboard 9 to hold plate 156 in position. In the shown embodiment, the screws are only used to hold the plate in position, and are only tightened down to a point prior to compressing foam 154. Pickup 152 is connected via wire 159 to socket 150 that extends through the back of cello body 110 (see FIG. 6) to allow pickup 152 to be plugged into an amplifier or other electronic equipment.

In one embodiment, supports are added to the folding cello that provide the ability to play standing up or to play while walking rather than the traditional sitting down playing stance. In one embodiment, a harness is used to support the folding cello while allowing the musician to have his/her arms free to play the instrument. The harness of one embodiment generally includes a pair of shoulder straps attached to a chest strap and to a waist strap with at least two metal support bars attached to the waist strap, with one bar on either side of the waist of the musician. The harness is first placed on the musician and fixed in place using adjustable material, such as, for example, Velcro. The chest strap and the waist strap are secured tightly around the musician. At least two straps are connected to the chest strap that are then wrapped around or otherwise attached to the chest support of the folding cello and secured in place. The bar on either side of the musician's waist is secured to the body of the folding cello near the base and allows for the folding cello to remain a fixed amount of space away from the musician with the proper angle for playing as if the musician were sitting down. The harness allows the musician to walk and play but keeps the folding cello secured to the musician at the proper angle for playing. It will be appreciated that other types of harnesses or support systems may be used without departing from the spirit or scope of the instant invention.

In another embodiment, the folding cello has a professional sound refinement system, including but not limited to, a preamp, built-in effects, and other components generally known in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the invention is by way of example, and the scope of the invention is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A musical instrument comprising:

a body;

a soundboard connected to said body via a connection; and a collapsible base connected to a lower portion of said body, said base including a center section and a leg support;

wherein said connection between said soundboard and said body allows said soundboard to vibrate independent of said body.

2. The musical instrument as claimed in claim 1 wherein said soundboard further includes a bridge connected to said soundboard.

3. The musical instrument as claimed in claim 1 wherein said connection comprises a spring.

4. The musical instrument as claimed in claim 1 wherein said leg support collapses as said center section is rotated toward a first position and wherein said leg support expands as said center section is rotated toward a second position.

5. A musical instrument comprising:

a body;

a soundboard connected to said body via a connection; and an acoustical pickup connected to said soundboard;

wherein said connection between said soundboard and said body allows said soundboard to vibrate independent of said body.

6. The musical instrument as claimed in claim 5 wherein said acoustical pickup comprises a head attached to said soundboard for receiving a vibration of said soundboard and a tubing attached to said head for transmitting said vibration to a headset.

7. The musical instrument as claimed in claim 5 further comprising a hermetic seal between said head and said soundboard.

8. The musical instrument as claimed in claim 1 further comprising a piezoelectric pickup attached to said soundboard.

9. The musical instrument as claimed in claim 1 wherein said instrument comprises a stringed instrument.

10. The musical instrument as claimed in claim 9 wherein said instrument comprises a cello.

11. A musical instrument comprising:

a body; and a base connected to said body such that said base is collapsible with respect to said body;

wherein said base comprises a center section and a leg support; and wherein said leg support collapses as said center section is rotated toward a first position and wherein said leg support expands as said center section is rotated toward a second position.

12. The musical instrument as claimed in claim 11 wherein said leg support is connected to said center section via a linkage.

13. The musical instrument as claimed in claim 12 wherein said linkage is connected to a sliding block that is slidably adjustable along said center section.

14. The musical instrument as claimed in claim 11 wherein said instrument comprises a cello.

15. A musical instrument comprising:

a soundboard; and an acoustical pickup, said acoustical pickup comprising a head attached to said soundboard for receiving a vibration of said soundboard, and a tubing attached to said head for transmitting said vibration to a headset.

16. The musical instrument as claimed in claim 15 further comprising a hermetic seal between said head and said soundboard.

17. The musical instrument as claimed in claim 15 wherein said instrument comprises a cello.

18. A musical instrument comprising:

a body; and a soundboard connected to said body via a connection;

wherein said connection between said soundboard and said body allows said soundboard to vibrate independent of said body;

wherein said instrument comprises a stringed instrument; and wherein said instrument comprises a cello.

* * * * *